US012318655B1

(12) United States Patent
Plesco

(10) Patent No.: US 12,318,655 B1
(45) Date of Patent: Jun. 3, 2025

(54) FOREARM MUSCLE TRAINING DEVICE

(71) Applicant: Afanasie Plesco, Miami, FL (US)

(72) Inventor: Afanasie Plesco, Miami, FL (US)

( * ) Notice: Subject to any disclaimer, the term of this patent is extended or adjusted under 35 U.S.C. 154(b) by 120 days.

(21) Appl. No.: 18/378,266

(22) Filed: Oct. 10, 2023

(51) Int. Cl.
*A63B 21/00* (2006.01)

(52) U.S. Cl.
CPC .... *A63B 21/4035* (2015.10); *A63B 21/00069* (2013.01); *A63B 21/4047* (2015.10)

(58) Field of Classification Search
CPC ..... A63B 21/00069; A63B 21/4035; A63B 21/4047
See application file for complete search history.

(56) References Cited

U.S. PATENT DOCUMENTS 4,171,802 A * 10/1979 Stoecker ..... A63B 21/008 482/46
4,585,363 A * 4/1986 McGuire ..... A63B 21/4047 482/44
6,406,406 B1 * 6/2002 Onorati ..... A63B 21/0004 601/40
8,951,169 B1 * 2/2015 Casper ..... A63B 21/4035 482/106
11,738,227 B2 * 8/2023 An ..... A63B 23/14 482/100
2014/0221164 A1 * 8/2014 Siniora ..... A63B 21/4049 482/46
2018/0272185 A1 * 9/2018 Barber ..... A63B 21/015

* cited by examiner

*Primary Examiner* — Joshua Lee
(74) *Attorney, Agent, or Firm* — Sandy Lipkin

(57) ABSTRACT

A tension adjustable forearm gripping exercise device that is made with large handles with a knurled surface made of aluminum and a center portion made of steel. The device is adjustable through the tension used in securing the handles through end cylinders into a center cylinder with a securing nut. Each handle terminates in a ball joint that is placed into end cylinders that are then attached to the center cylinder where the tension adjusting securing nuts are tightened to the end cylinders/handles to the desired tension.

12 Claims, 9 Drawing Sheets

FOREARM MUSCLE TRAINING DEVICE

BACKGROUND OF THE INVENTION

Field of the Invention

The field of this invention relates generally to the field of exercise devices and more particularly toward a forearm muscle training device.

Description of the Prior Art

In the field of exercise, outside equipment is often used to strengthen specific muscles through isolated movements that target specific muscle groups. The forearm muscle, in particular, is strengthened by applying resistance to the grip.

It is the object of the instant invention to provide for a novel gripping exercise device that strengthens forearm muscles.

It is a further object of the instant invention to provide for a novel gripping device with thicker handles that typical grippers for better activation of the forearm muscles.

It is a further object of the instant invention to provide for a novel gripping device with knurled handles for better anti-slipping grip.

It is a further object of the instant invention to provide for a novel gripping device that is made of durable materials.

It is a further object of the instant invention to provide for a novel gripping device that is adjustable in resistance.

SUMMARY OF THE INVENTION

The basic embodiment of the present invention teaches a gripping exercise device comprising: a center cylindrical member said center cylinder member further comprising: a first end opening with male threading; a second end opening with male threading; a first tightening nut proximate said first end opening; and a second tightening nut proximate said second end opening; a first end cylinder attachable to said first end of said center cylindrical member, said first end cylinder further comprising: a first end opening with female threading; and a second end opening; a second end cylinder attachable to said second end of said center cylindrical member, said second end cylinder further comprising: a first end opening with female threading; and a second end opening; a first handle, said first handle having a bottom end and a top end, said top end having a ball joint proximate thereto; a second handle, said second handle having a bottom end and a top end, said top end having a ball joint proximate thereto; wherein said top end each of said first and second handles fitting securely inside of said first and said second end cylinders; a first blocking puck proximate said ball joint of said first handle; a second blocking puck proximate said ball joint of said second handle; a first securing disc proximate said first blocking puck; and a second securing disc proximate said second blocking puck.

The above embodiment can be further modified by defining that said first and second handles have a diameter greater than 9 cm.

The above embodiment can be further modified by defining that said first and second handles have knurled surfaces for anti-slipping properties.

The above embodiment can be further modified by defining that said center cylinder is made of steel.

The above embodiment can be further modified by defining that said first and second end cylinders are made of steel.

The above embodiment can be further modified by defining that said first and second handles are made of aluminum.

An alternate embodiment of the instant inventions teaches a method of adjusting tension on a forearm gripping device comprising the steps of: acquiring a specialized gripping exercise device, said specialized gripping device further comprising: a center cylindrical member said center cylinder member further comprising: a first end opening with male threading; a second end opening with male threading; a first tightening nut proximate said first end opening; and a second tightening nut proximate said second end opening; a first end cylinder attachable to said first end of said center cylindrical member, said first end cylinder further comprising: a first end opening with female threading; and a second end opening; a second end cylinder attachable to said second end of said center cylindrical member, said second end cylinder further comprising: a first end opening with female threading; and a second end opening; a first handle, said first handle having a bottom end and a top end, said top end having a ball joint proximate thereto; a second handle, said second handle having a bottom end and a top end, said top end having a ball joint proximate thereto; wherein said top end each of said first and second handles fitting securely inside of said first and said second end cylinders; a first blocking puck proximate said ball joint of said first handle; a second blocking puck proximate said ball joint of said second handle; a first securing disc proximate said first blocking puck; and a second securing disc proximate said second blocking puck; placing said bottom end of said first handle through said first end of said first end cylinder until said first ball joint is secured at said second end opening of said first end cylinder; placing said first blocking puck through said first end of said first end cylinder until said blocking puck is secured proximate said first ball joint; placing said first securing disc through said first end of said first end cylinder until said first securing disc is secured proximate said first ball joint; placing said bottom end of said second handle through said first end of said second end cylinder until said second ball joint is secured at said second end opening of said second end cylinder; placing said second blocking puck through said first end of said second end cylinder until said blocking puck is secured proximate said second ball joint; placing said second securing disc through said first end of said second end cylinder until said second securing disc is secured proximate said second ball joint; threading said threaded first end of said first end cylinder with said first end of said center male threads on said center cylinder; securing said first end cylinder to said center cylinder through the rotation of said first securing nut to the desired tension level; and threading said threaded first end of said second end cylinder with said second end of said center male threads to said center cylinder through the rotation of said second securing nut to the desired tension level.

The above embodiment can be further modified by defining that said first and second handles have a diameter greater than 9 cm.

The above embodiment can be further modified by defining that said first and second handles have knurled surfaces for anti-slipping properties.

The above embodiment can be further modified by defining that said center cylinder is made of steel.

The above embodiment can be further modified by defining that said first and second end cylinders are made of steel.

The above embodiment can be further modified by defining that said first and second handles are made of aluminum.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
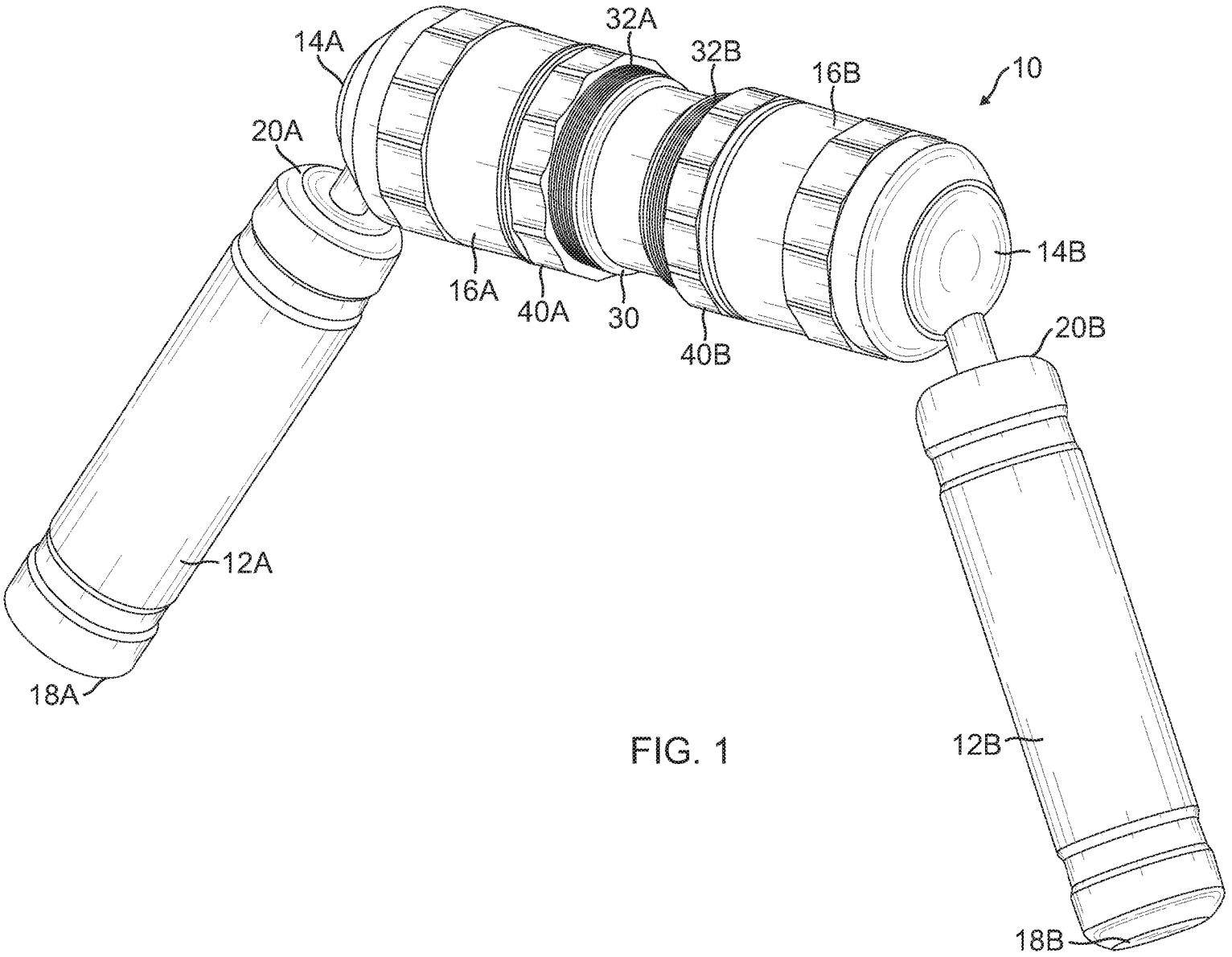
FIG. 1 is a top perspective view of the forearm muscle training device of the instant invention.
Figure 2:
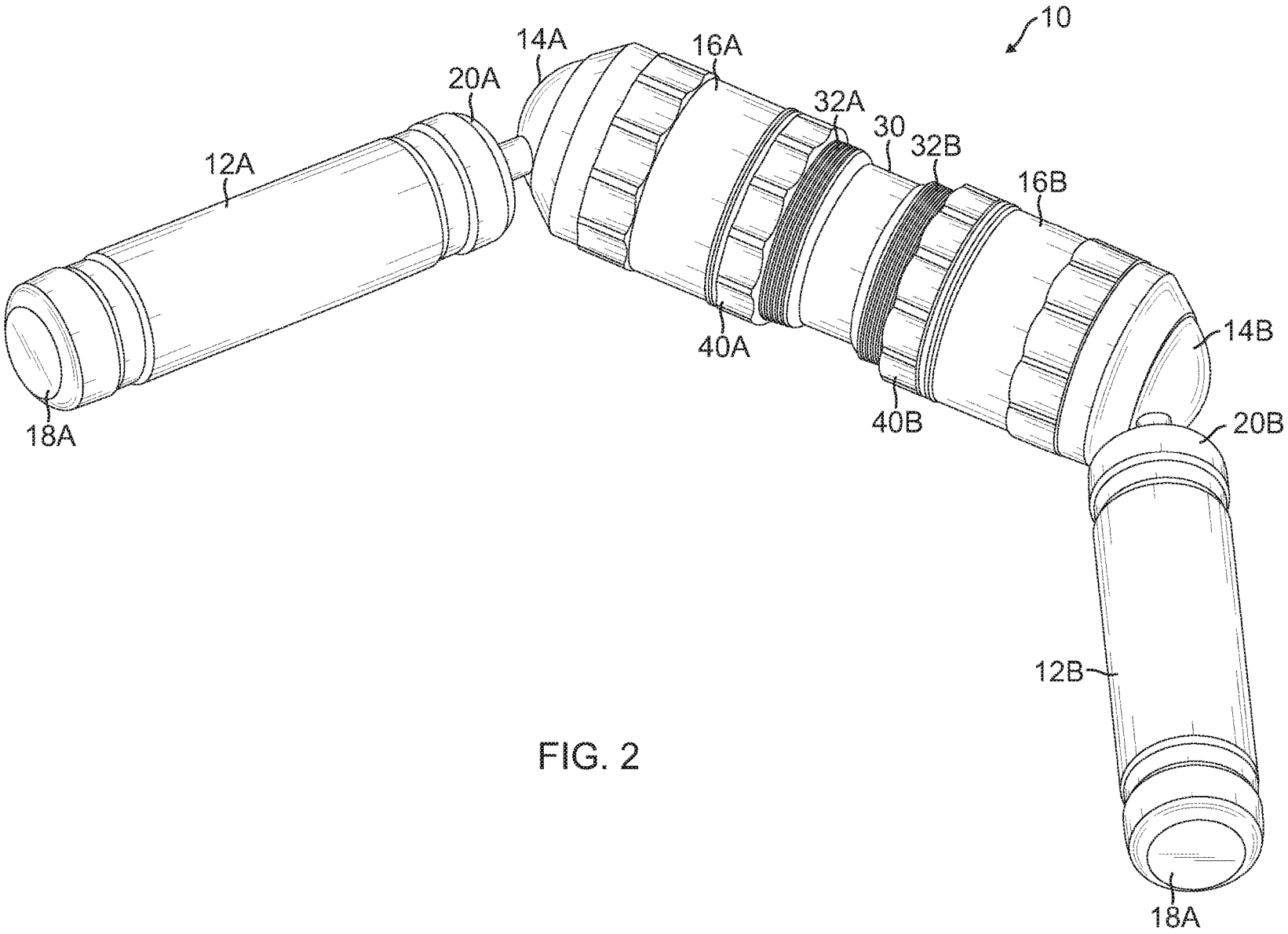
FIG. 2 is a bottom perspective view of the forearm muscle training device of the instant invention.
Figure 3:
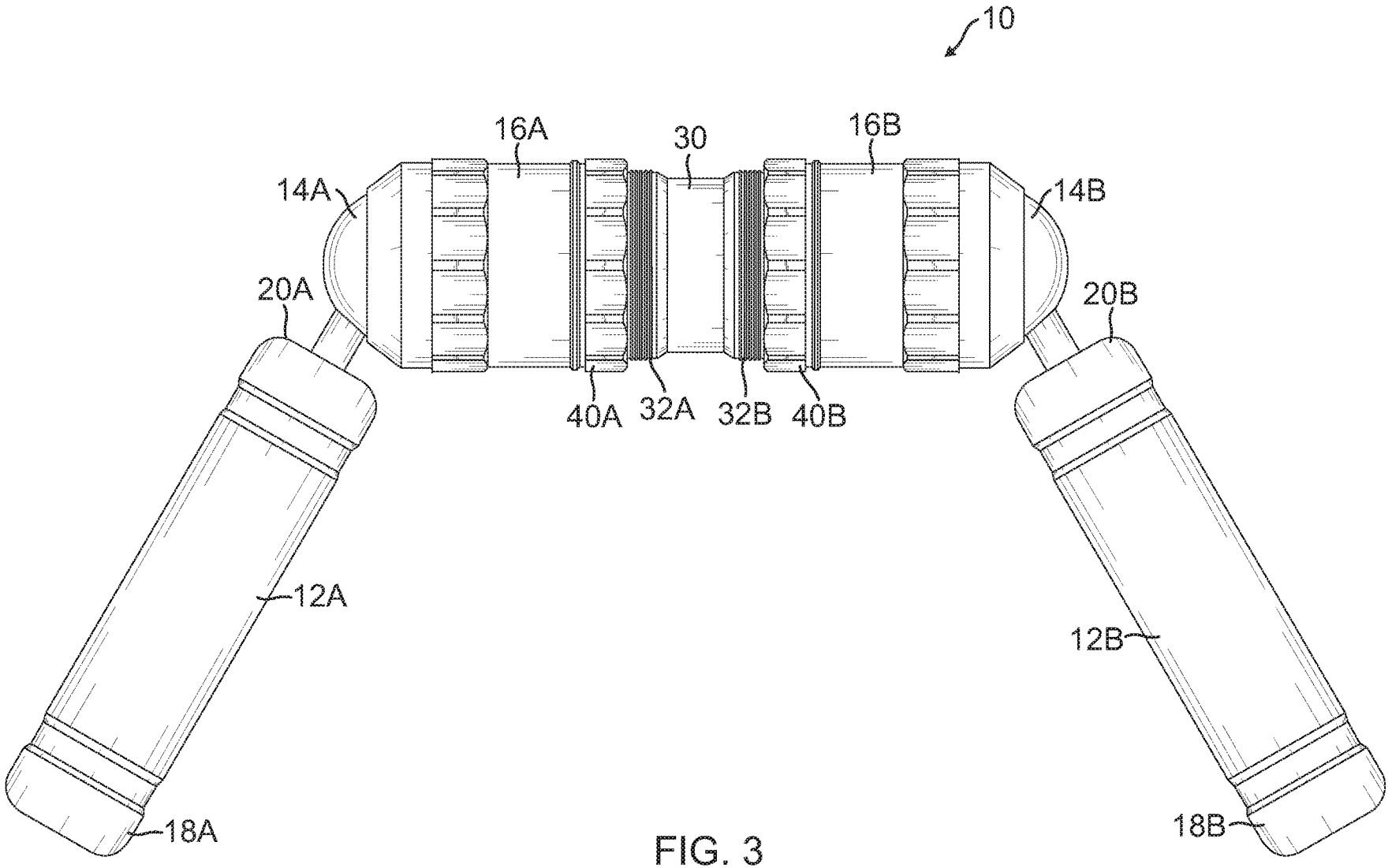
FIG. 3 is a front view of the forearm muscle training device of the instant invention.
Figure 4:
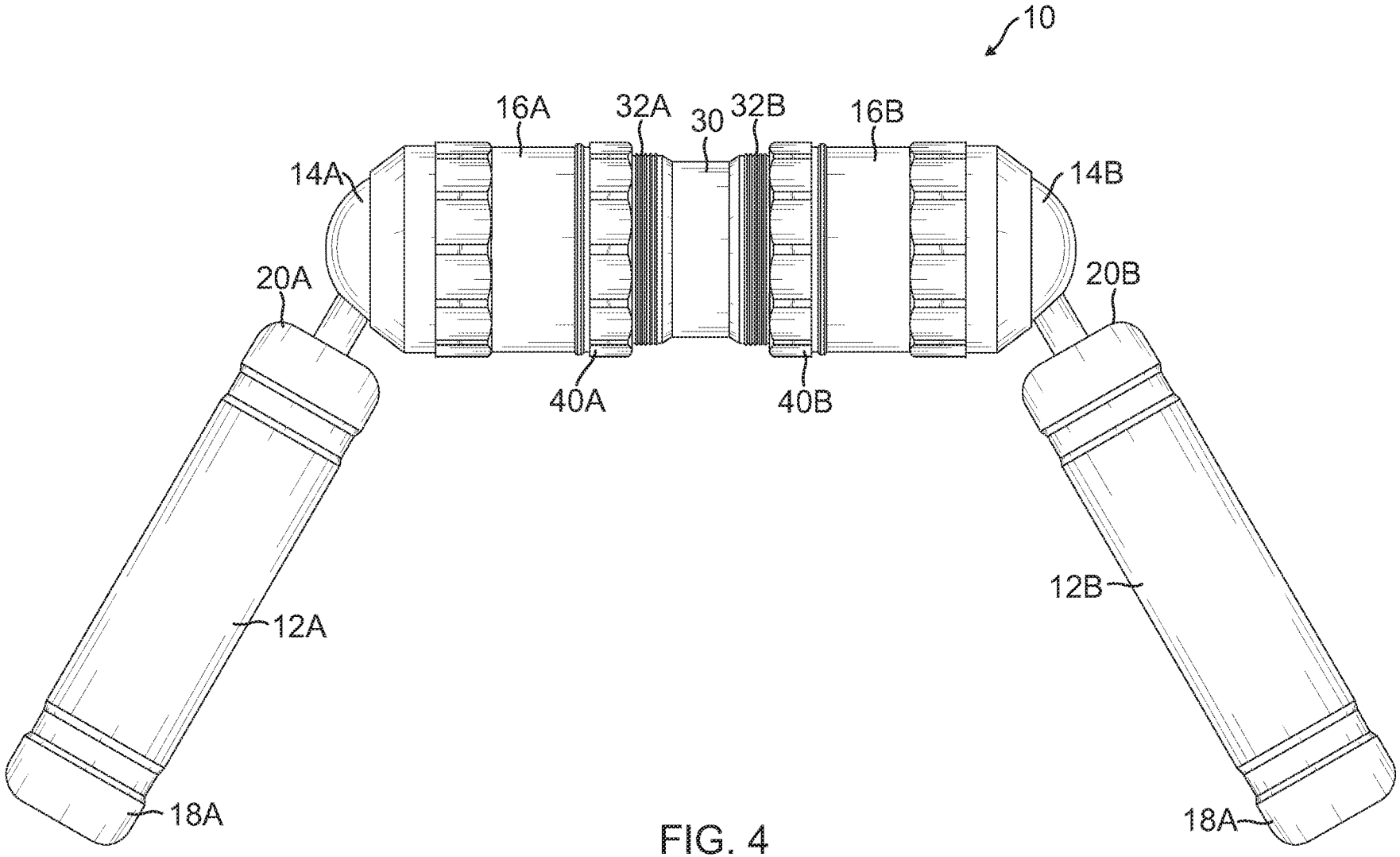
FIG. 4 is a rear view of the forearm muscle training device of the instant invention.
Figure 5:
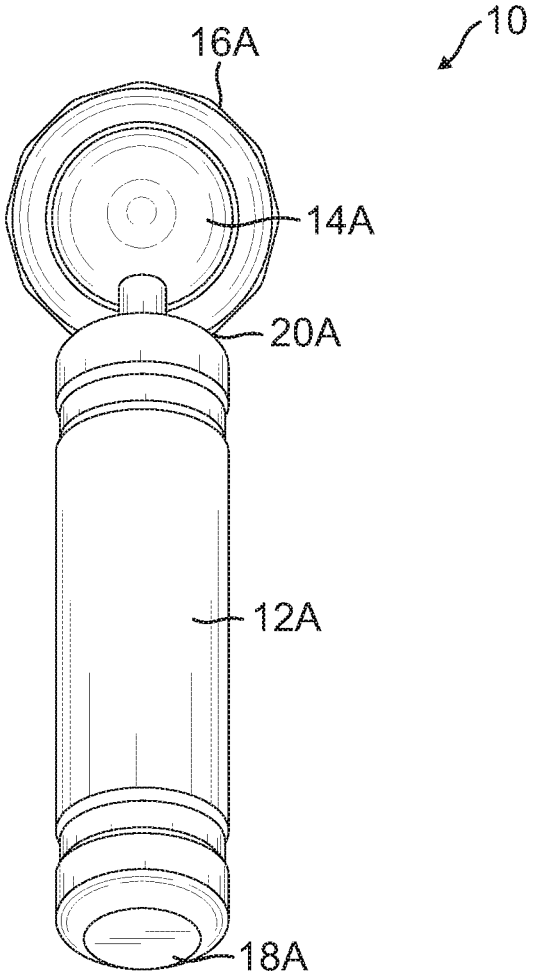
FIG. 5 is a left side view of the forearm muscle training device of the instant invention.
Figure 6:
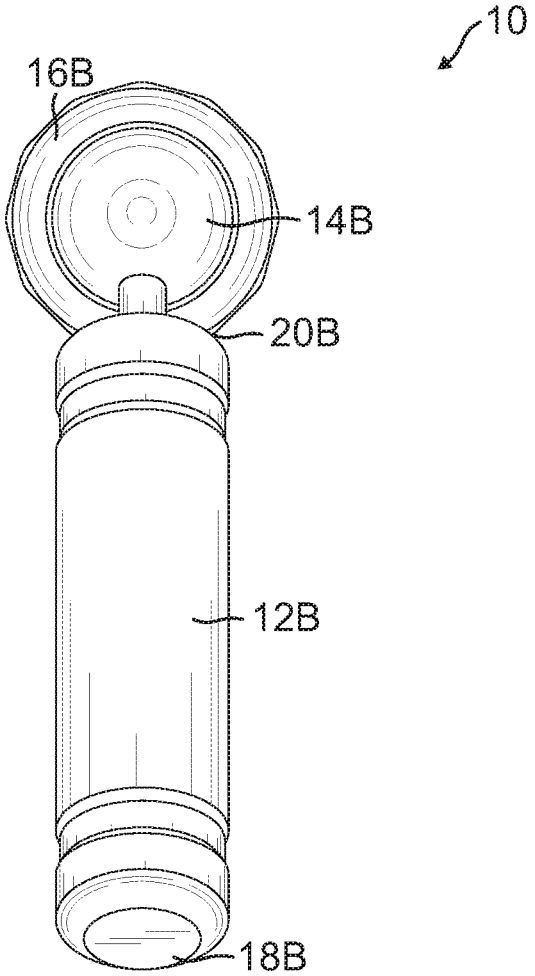
FIG. 6 is a right side view of the forearm muscle training device of the instant invention.
Figure 7:
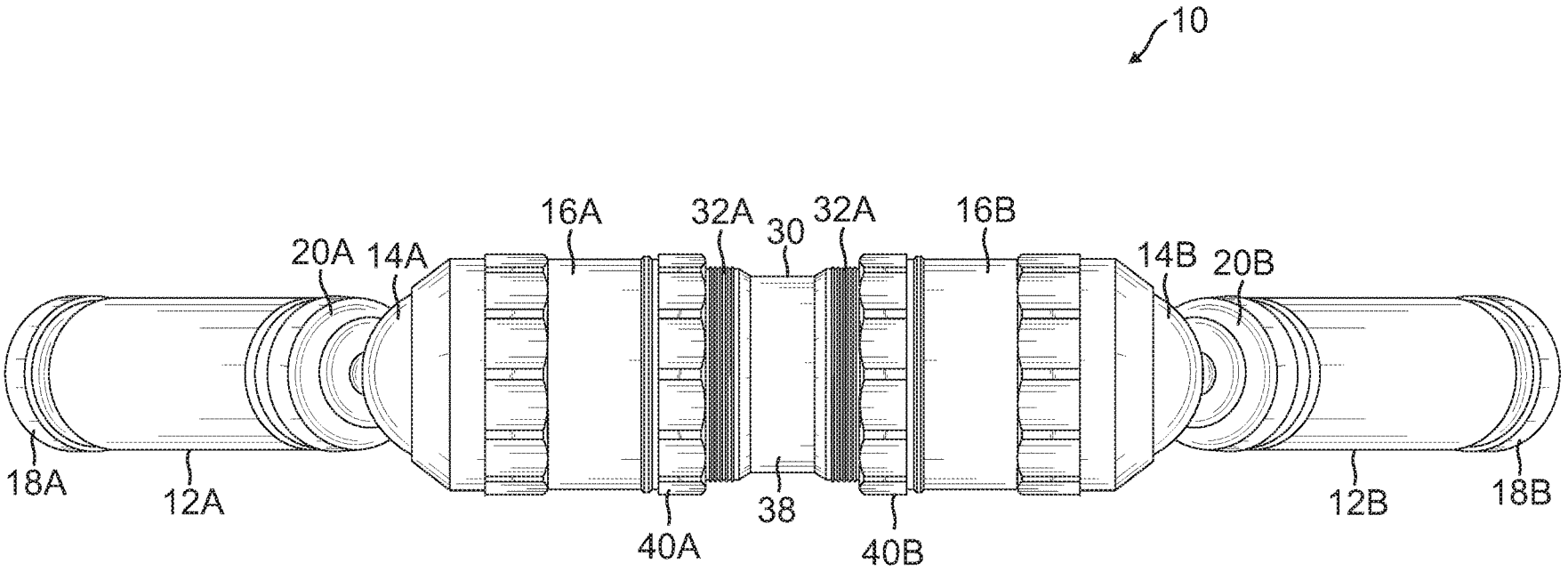
FIG. 7 is a top view of the forearm muscle training device of the instant invention.
Figure 8:
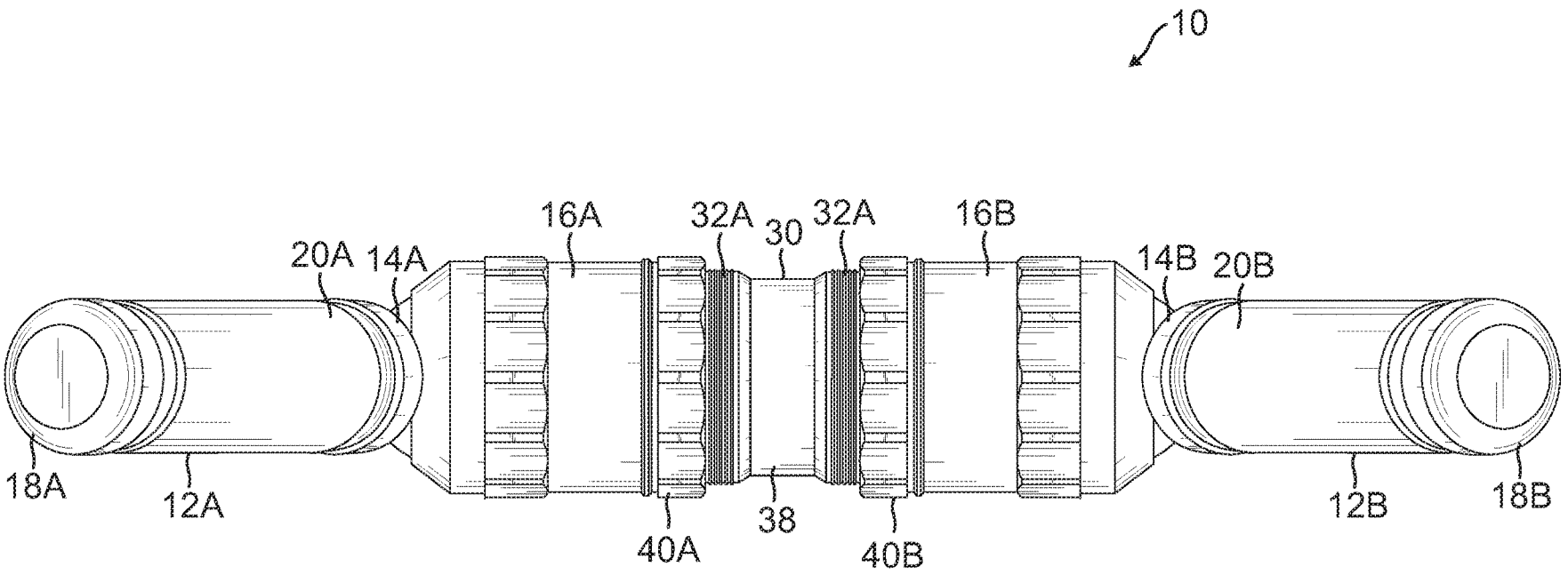
FIG. 8 is a bottom view of the forearm muscle training device of the instant invention.
Figure 9:
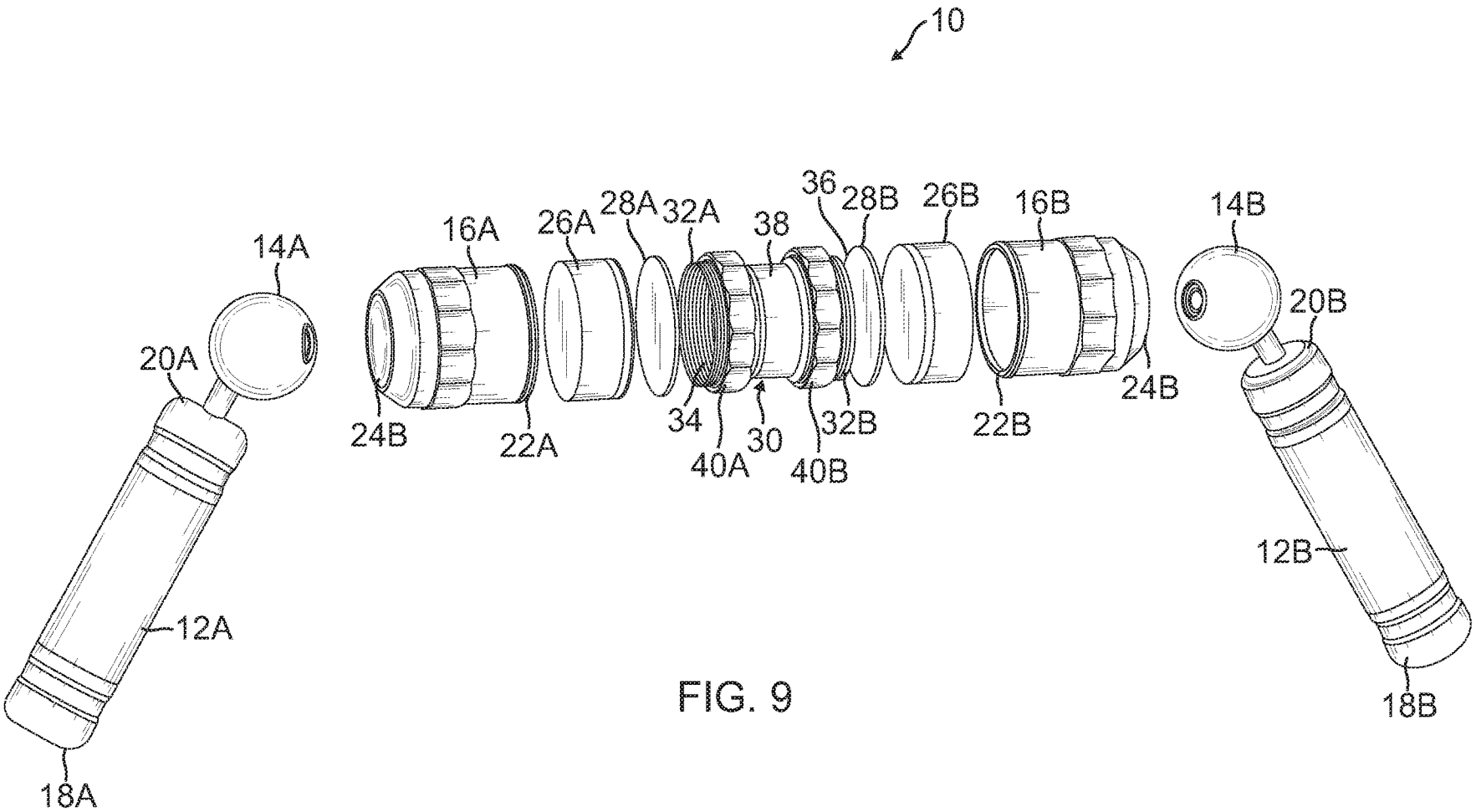
FIG. 9 is an exploded front view of the forearm muscle training device of the instant invention.

Turning to the drawings, the preferred embodiment is illustrated and described by reference characters that denote similar elements throughout the several views of the instant invention.

The instant invention provides for an exercise device 10 designed to strengthen the forearm gripping muscles of the user. The device 10 is symmetrical and has handles 12A, 12B on either end. Each handle 12A, 12B has an outer bottom end 18A, 18B and an inner end 20A, 20B that is proximate the rest of the device. At the inner end 20A, 20B of each handle 18A, 18B is a ball joint 14A,14B. Each handle 12A, 12B is then attachable to a center cylinder 30 that adjustably attaches to cylinders 16A, 16B on either side of the center cylinder 30.

The end cylinders 16A, 16B each have an inside opening with female threads 22A, 22B and an outside opening 24A, 24B. Each handle 12A, 12B slips into the outside opening 24A, 24B on each end cylinder 16A, 16B through the outer bottom end 18A, 18B of each handle 12A, 12B. The ball joint 16A, 16B on each handle 12A, 12B sets into the outside aperture 24A, 24B of each end cylinder 16A, 16B. Proximate each ball joint 14A, 14B once it is secured into the outside aperture 24A, 24B of each end cylinder 16A, 16B is placed a blocking puck 26A, 26A. Outside of each blocking puck 26A, 26B is a securing disc 28A, 28A that secures the ball joint 14A, 14B inside of the end cylinder 16A, 16B.

Once each handle 12A, 12B is secured into each end cylinder 16A, 16B with each blocking puck 26A, 26B and each securing disc 28A, 28B, then each end cylinder 16A, 16B is connected to the center cylinder 30. The center cylinder 30 has a center portion 38 with securing nuts 40A, 40B on either end. Also on either end is an opening 34, 36 with male threads 32A, 32B. Each handle 12A, 12B secured to an end cylinder 16A, 16B can then be attached to the center cylinder 30 through each opening 34, 36. Once each end cylinder 16A, 16B is placed into each opening 34, 36 of the center cylinder 30, the tension can be adjusted by how tightly each securing 40A, 40B is fastened to each end cylinder 16A, 16B.

The handles 12A, 12B are made to have a large diameter which increases the difficulty of the exercise. The diameter of each handle will be greater than 9 cm. Each handle 12A,12B has a knurled textured surface to provide anti-slip effects. The device, excluding the handles is made of a steel body while the handles are made of aluminum. Prior art devices are typically made with wooden handles so the use of aluminum provides durability not found in the prior art. The construction of the steel center cylinder and end cylinders likewise provides durability not found in prior art devices.

The invention illustratively disclosed herein suitably may be practiced in the absence of any element which is not specifically disclosed herein.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A gripping exercise device comprising:

a center cylindrical member comprising:

a first end opening with male threading;

a second end opening with male threading;

a first tightening nut proximate said first end opening; and a second tightening nut proximate said second end opening;

a first end cylinder attachable to said first end opening of said center cylindrical member, said first end cylinder comprising:

a first end opening with female threading; and a second end opening;

a second end cylinder attachable to said second end opening of said center cylindrical member, said second end cylinder comprising:
a first end opening with female threading; and
a second end opening;
a first handle, said first handle having a bottom end and a top end, said top end having a ball joint proximate thereto;
a second handle, said second handle having a bottom end and a top end, said top end having a ball joint proximate thereto;
wherein said top end of each of said first and second handles fitting securely inside of respective said first and said second end cylinders;
a first blocking puck proximate said ball joint of said first handle;
a second blocking puck proximate said ball joint of said second handle;
a first securing disc proximate said first blocking puck; and
a second securing disc proximate said second blocking puck.

2. The gripping exercise device as defined in claim 1 wherein said first and second handles have a diameter greater than 9 cm.

3. The gripping exercise device as defined in claim 1 wherein said first and second handles have knurled surfaces for anti-slipping properties.

4. The gripping exercise device as defined in claim 1 wherein said center cylindrical member is made of steel.

5. The gripping exercise device as defined in claim 1 wherein said first and second end cylinders are made of steel.

6. The gripping exercise device as defined in claim 1 wherein said first and second handles are made of aluminum.

7. A method of adjusting tension on a forearm gripping device comprising the steps of:
acquiring a specialized gripping exercise device, said specialized gripping device comprising:
a center cylindrical member comprising:
a first end opening with male threading;
a second end opening with male threading;
a first tightening nut proximate said first end opening; and
a second tightening nut proximate said second end opening;
a first end cylinder attachable to said first end opening of said center cylindrical member, said first end cylinder comprising:
a first end opening with female threading; and
a second end opening;
a second end cylinder attachable to said second end opening of said center cylindrical member, said second end cylinder comprising:
a first end opening with female threading; and
a second end opening;
a first handle, said first handle having a bottom end and a top end, said top end having a ball joint proximate thereto;
a second handle, said second handle having a bottom end and a top end, said top end having a ball joint proximate thereto;
wherein said top end of each of said first and second handles fitting securely inside of respective said first and said second end cylinders;
a first blocking puck proximate said ball joint of said first handle;
a second blocking puck proximate said ball joint of said second handle;
a first securing disc proximate said first blocking puck; and
a second securing disc proximate said second blocking puck;
placing said bottom end of said first handle through said first end of said first end opening cylinder until said first ball joint is secured at said second end opening of said first end cylinder;
placing said first blocking puck through said first end opening of said first end cylinder until said blocking puck is secured proximate said first ball joint;
placing said first securing disc through said first end of said first end cylinder until said first securing disc is secured proximate said first ball joint;
placing said bottom end of said second handle through said first end opening of said second end cylinder until said second ball joint is secured at said second end opening of said second end cylinder;
placing said second blocking puck through said first end opening of said second end cylinder until said blocking puck is secured proximate said second ball joint;
placing said second securing disc through said first end opening of said second end cylinder until said second securing disc is secured proximate said second ball joint;
threading said threaded first end opening of said first end cylinder with said male threaded first end opening of said center cylindrical member;
securing said first end cylinder to center cylindrical member through rotation of said first tightening nut to a desired tension level; and
threading threaded first end opening of said second end cylinder with said male threaded second end opening of said center cylindrical member through rotation of said second tightening nut to a desired tension level.

8. The method as defined in claim 7 wherein said first and second handles have a diameter greater than 9 cm.

9. The method as defined in claim 7 wherein said first and second handles have knurled surfaces for anti-slipping properties.

10. The method as defined in claim 7 wherein said center cylindrical member is made of steel.

11. The method as defined in claim 7 wherein said first and second end cylinders are made of steel.

12. The method as defined in claim 7 wherein said first and second handles are made of aluminum.

* * * * *